United States Patent [19]

Zeigler

[11] Patent Number: 4,473,986

[45] Date of Patent: Oct. 2, 1984

[54] COLLAPSIBLE/EXPANDABLE STRUCTURAL MODULE WITH SPLIT HUB LOCKING

[76] Inventor: Theodore R. Zeigler, 9923 Indian Queen Point Rd., Oxon Hill, Md. 20022

[21] Appl. No.: 458,364

[22] Filed: Jan. 17, 1983

[51] Int. Cl.[3] ..... E04H 12/18

[52] U.S. Cl. ..... 52/645; 52/648; 403/171

[58] Field of Search ..... 52/648, 645, 650; 403/69, 70, 71, 170, 171, 172, 176

[56] References Cited

U.S. PATENT DOCUMENTS

| | | | |
|---|---|---|---|
| 3,220,152 | 11/1965 | Sturm | 52/648 |
| 3,861,107 | 1/1975 | Papayoti | 403/171 |
| 3,968,808 | 7/1976 | Zeigler | 52/81 |
| 4,129,975 | 12/1978 | Gabriel | 52/648 |
| 4,332,501 | 6/1982 | Slysh | 403/171 |

*Primary Examiner*—Henry E. Raduazo

*Attorney, Agent, or Firm*—Diller, Ramik & Wight

[57] ABSTRACT

A structural module formed by expanding a bundle of struts joined by hubs is locked in expanded condition by joining two components of a split hub assembly. The module may be two-dimensional or three-dimensional and plural modules may be combined to form a composite.

7 Claims, 12 Drawing Figures

FIG.1
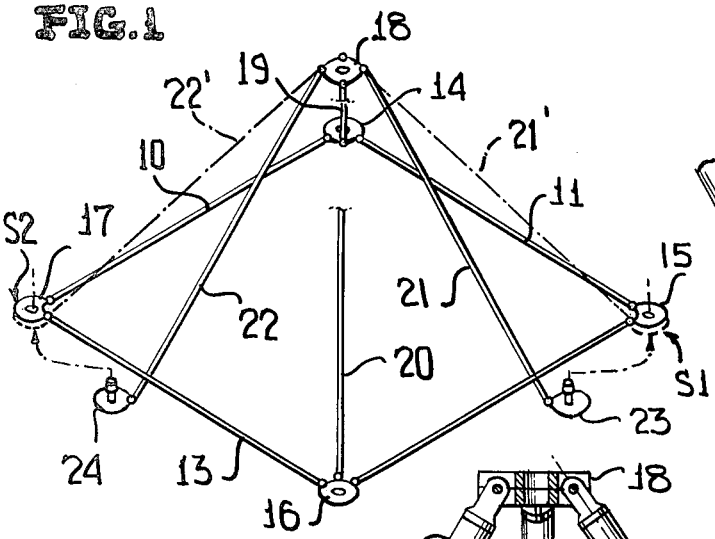
FIG.2
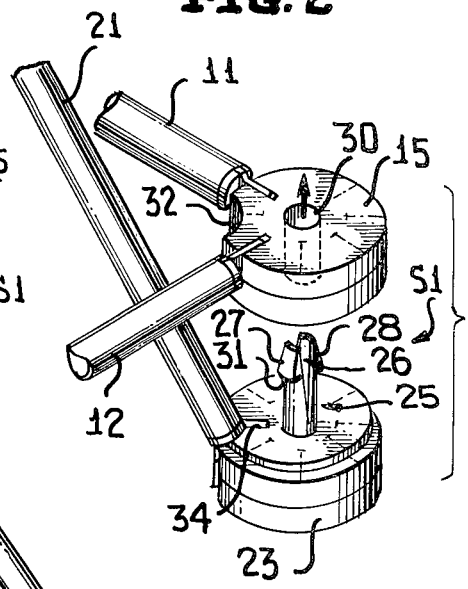
FIG.3
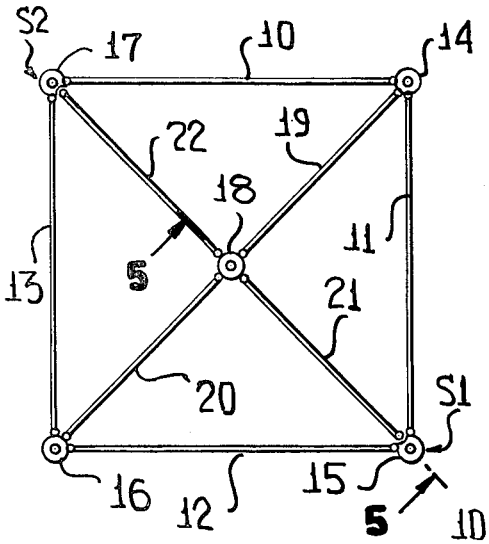
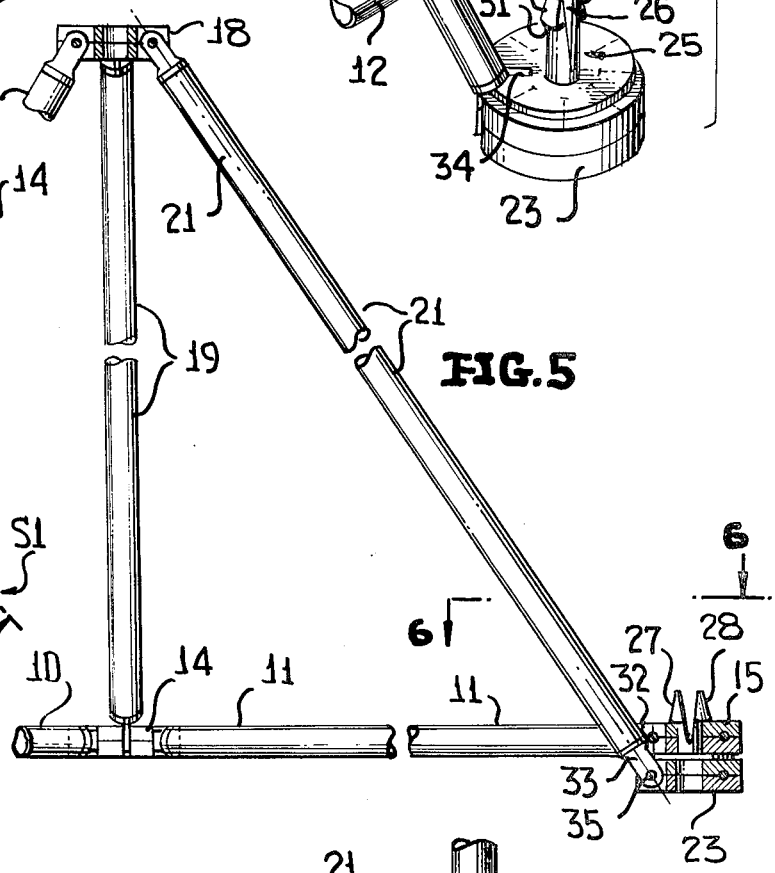
FIG.5
FIG.4
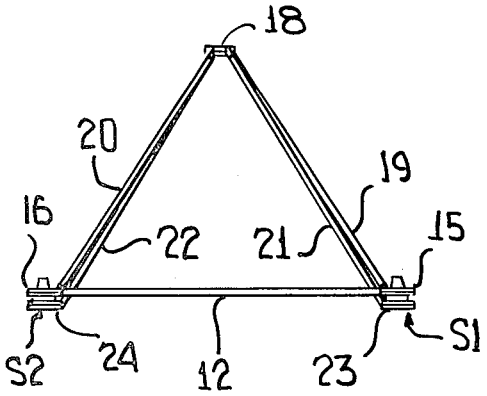
FIG.6
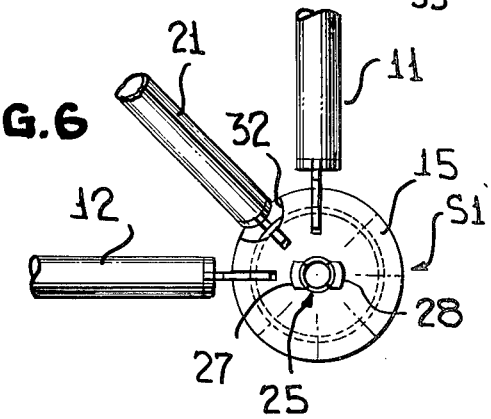

COLLAPSIBLE/EXPANDABLE STRUCTURAL MODULE WITH SPLIT HUB LOCKING

BACKGROUND OF THE INVENTION

This invention is concerned with structural modules which are in the form of rod elements pivotally joined by hub means so that the module may be collapsed into a compact bundle of rod elements and may be expanded into a frame. Devices of this general type are the subject of my prior U.S. Pat. Nos. 3,968,808; 4,026,313; 4,290,244; and 4,280,521. In all of these patents, the structures are "self supporting", i.e., they are characterized by the fact that structural integrity in the expanded form is achieved by stresses induced in the framework incidental to being expanded to full shape or form, without the aid of or necessity for an extraneous locking means. The Derus U.S. Pat. No. 4,276,726 also discloses a similar type of structure but further discloses an arrangement which achieves lock-up not by the aforesaid self-supporting action, but by means of a "releasable locking link" which is used to hold the structure in fully expanded form without imposing any self-induced stress in the rod elements. The module of this latter configuration involves a circumscribing series of pairs of crossed rod elements which are pivotally joined in scissored fashion. In collapsed form, these scissored pairs of rod elements form a bundle and in expanded form they describe, in zig-zag fashion, the side boundaries of a rectangular parallelepiped. The ends of the zig-zag related rod elements are joined by hub means, one group of which defines the corners of a square in one plane and the other group of which defines the corners of a second square in a second plane close to the first plane. Radiating inwardly from the corners defined by one group of hubs are a series of further rod elements whose inner ends are joined by a further hub. These latter rod elements and their related hubs limit the extent to which the structure may be expanded, this occuring when the aforesaid one group of hubs and the inwardly radiating rod elements are coplanar. The releasable locking means is operatively positioned when the structure has been expanded to prevent collapse of the structure by preventing the planes containing the two groups of hub means from moving apart.

BRIEF SUMMARY OF THE INVENTION

This invention relates to a collapsible/expandable structural module which when expanded and locked by means of at least one split hub assembly forms a rigid frame which may be used alone as a structural unit or combined with other units to form a composite frame.

In one aspect, the present invention relates to a structural module capable of being manipulated between a collapsed, bundled condition and an expanded, locked condition presenting a rigid, three-dimensional space frame, and characterized by the presence of cooperating hub means which form a split hub assembly whose purpose and function it is to lock the frame in expanded condition.

In another aspect, this invention concerns a space frame as aforesaid which is of pyramidal shape and in which a split hub assembly is located at a corner of the base of the pyramid, or two split hub assemblies are disposed at diagonally opposite corners of the base. In this way, a rigid space frame is formed with a minimum number of rod elements. The base is circumscribed by a series of single rod elements connected at their ends by hub means, rather than requiring circumscribing pairs of scissored rod elements as described above.

Another aspect of this invention is concerned with a module which, when expanded, is characterized by having a circumscribing series of rod elements which are interconnected at their ends by hub means and in which the series of rod elements are generally coplanar so as to lie along and define the sides of a polygon and in which they are locked in this configuration by means of at least one pair of hub means which constitute a split hub assembly, means being provided to a releasably lock the pair of hub means forming the split hub assembly together. The pair of hub means forming the split hub assembly retreat from each other when the module is unlocked and moved toward the collapsed, bundled condition.

Another aspect of this invention concerns the fact that modules of this invention may be joined together by sharing a common side of a polygon.

BRIEF DESCRIPTION OF THE DRAWING FIGURES

FIG. 1 is a perspective view of one form of module according to the present invention;

FIG. 2 is an enlarged perspective view showing a split hub assembly;

FIG. 3 is a plan view of the module shown in FIG. 1;

FIG. 4 is a side elevational view of the module shown in FIGS. 1 and 3;

FIG. 5 is an enlarged sectional view taken substantially along the plane of section 5—5 in FIG. 3;

FIG. 6 is a plane view of the split hub assembly shown in FIG. 2;

DETAILED DESCRIPTION OF THE INVENTON

Figures 7, 8, 9, 10, 11, 12:
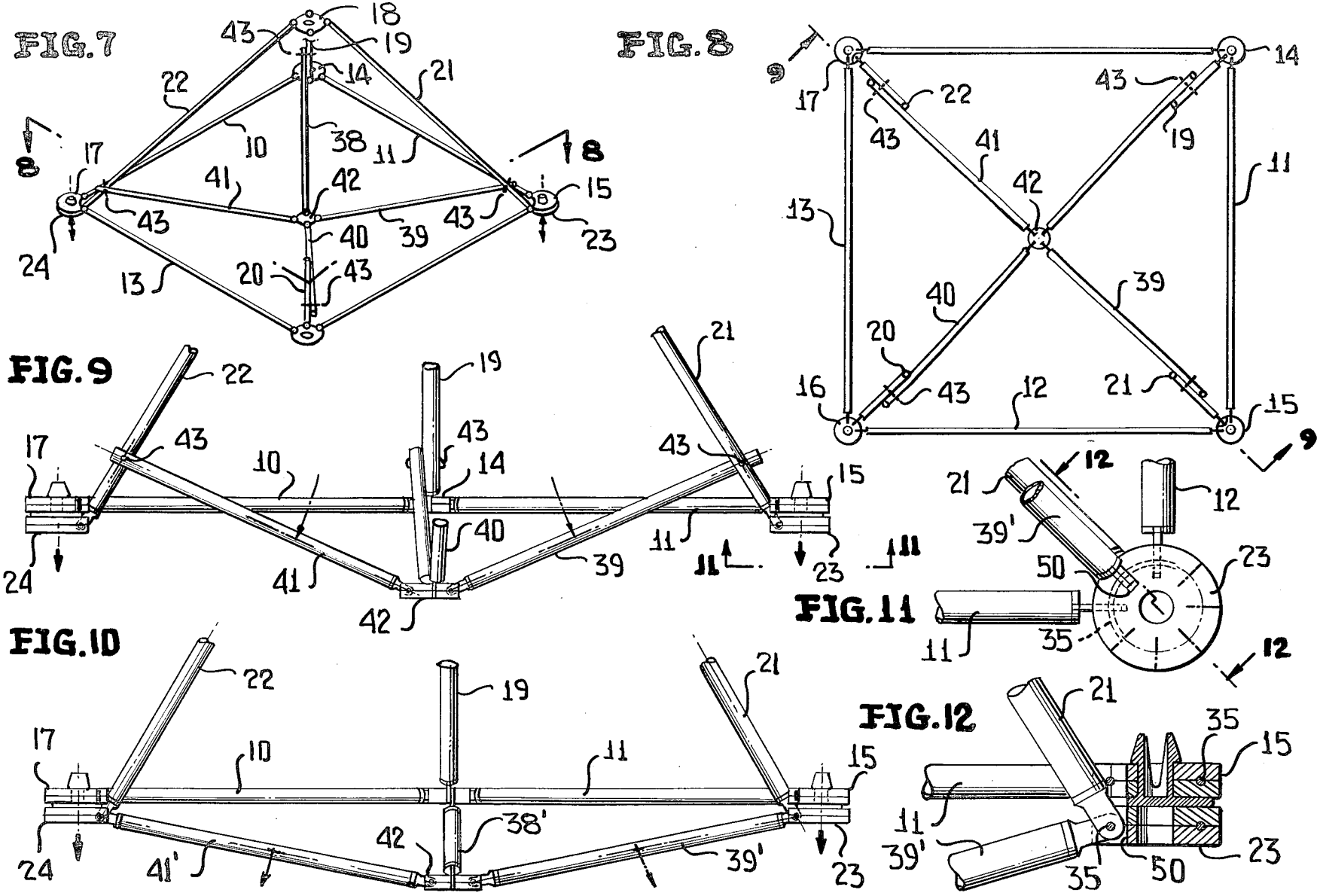
FIG. 7 is a view similar to FIG. 1 but showing additional reinforcing means added thereto.
FIG. 8 is a horizontal sectional view taken substantially along the plane of section 8—8 in FIG. 7.
FIG. 9 is a vertical section taken substantially along the plane of section line 9—9 in FIG. 8.
FIG. 10 is a view similar to FIG. 9 but showing a further modification of the reinforcing means.
FIG. 11 is a plan view of one of the split hub assemblies of FIG. 10.
FIG. 12 is a sectional view taken substantially along the plane of section line 12—12 in FIG. 11.

Referring at first more particularly to FIGS. 1, 3 and 4, the module shown therein includes the rod elements 10, 11, 12 and 13 which, as shown, lie along and define the sides of a square when the module is in the expanded condition as shown. In this form of the module, the adjacent end of the two rod elements 10 and 11 are joined by a hub means 14; the adjacent ends of the rod elements 11 and 12 are joined by a hub means 15; the adjacent ends of the rod elements 12 and 13 are joined by a hub means 16 and the adjacent ends of the rod elements 10 and 13 are joined by the hub means 17. Also in this form of the invention, a hub means 18 is provided and pivotally attached to this hub means 18 and extending therefrom into pivotal connection with the hub means 14 and 16 are the rod elements 19 and 20. There are two additional rod elements 21 and 22 which are pivotally connected to the hub means 18 and the respective opposite ends of these rod elements 21 and 22 are pivotally attached to the hub means 23 and 24 as shown. All of the hub means previously described are of the "ring and blade" type which forms the subject matter of my prior U.S. Pat. No. 4,280,521, the disclosure of which is incorporated herein by reference thereto. Although other and different types of hubs may be utilized, it is preferred that the aforesaid "ring and blade" type of hub be utilized.

For the sake of clarity in FIG. 1, the two rod elements 21 and 22 and their associated hubs 23 and 24 are shown swung aside and out of their operative positions to illustrate the split hub concept of this invention. It is to be noted that the fully erected condition of the rod elements 21 and 22 is depicted by the broken lines 21' and 22' in FIG. 1. As is shown more clearly in FIG. 2, the hub 23 is provided at its center with an upstanding stub 25 which is bifurcated at 26 to present the headed tips 27 and 28. The stem portion 29 below the headed portions 27 and 28 is of a length commensurate with the thickness of the hub 15 so that when the member 25 is forced into the central opening 30 of the hub 15, the bifurcated portions will squeeze together until the headed portions 27 and 28 spring apart to lock the assembly in the position shown in FIG. 5. The headed portions 27 and 28 are slightly rounded as at 31 to allow the two hubs 15 and 23 to be forced apart simply by separating them manually. Of course, other and different means may be employed to secure the hubs 15 and 23 together in their superposed position shown in FIG. 5. It will be understood further that the same arrangement prevails for the two hubs 17 and 24 at the opposite corner of the polygon defined by the rod elements 10, 11, 12 and 13.

It will be understood that the rod elements 10, 11, 12 and 13 are of equal lengths so that they, in fact, form a square in the expanded condition of the module and it should further be noted that the rod elements 19, 20, 21 and 22 are of equal lengths, preferably the same lengths as are the polygon-bounding rod elements 10, 11, 12 and 13. In the collapsed, bundled condition of the module, the three hub means 15, 17 and 18 are grouped together at one end of the bundle whereas the hub means 14, 16, 23 and 24 are grouped together at the other end of the bundle, the rod elements all then being disposed in generally parallel and close together relationship to define the bundle at whose ends the groups of hub means as aforesaid are located.

It will be appreciated that two modules such as are shown in FIG. 1, 3 and 4 may be combined to provide a composite frame in the expanded condition while, at the same time, being capable of collapse to the bundled condition as aforesaid with, of course, the requisite additional rod elements being included in such bundle. The manner in which such module may be combined is simply by sharing a common side or sides of the square as defined by any one or more of the rod elements 10, 11 and 13. Thus, for example, if a further module is formed by sharing a common rod element 12, there will be additional hub means corresponding to the hubs 14 and 17 as well as an additional hub corresponding to the hub 18 and to the hub 24. In this case, the hub corresponding to 18 will have also associated with it a rod element corresponding to 21 and joined to the existing split hub component 23 already shown and the additional rod element corresponding to 22 and its corresponding split hub component 24 will cooperate with a split hub component corresponding to the hub means 17 in line with the two hubs 16 and 17 illustrated. Thus, the hub means 16 will have additionally associated with it one end of a rod element corresponding to the rod element 13 and one end of a rod element corresponding to the rod element 20, and so forth. Such a combined module assembly will be characterized by the fact that the two module components thereof will be free to pivot along an axis defined between the hubs 15 and 16 but that this pivotal action may be eliminated by employing an additional rod element between the hub means 18 and the corresponding hub means of the second module wherein a split hub arrangement is effected between the opposite end of this additional rod means and the hub means of the second module corresponding to the hub means 18. It should be noted that the length of this additional rod means will dictate whether the planes of the two polygons of the two modules will be coplanar or at an angle to each other.

It will further be appreciated that the open space frame defined by a module according to this invention may be, rather than of pyramid shape as shown in FIG. 1, of other and different polygonal configurations as, for example, the open space frame may define a tetrahedron. It should also be noted that in accord with this invention, the expanded form of the module may be essentially two-dimensional, i.e., the polygon-bounding rod elements 10, 11, 12 and 13 being joined at one corner by a split hub assembly with a diagonally expanding further rod element joining the opposite corner hub means with one component of this split hub assembly. In this case, all rod elements must be of equal length so that, in this case, the polygon is diamond shape, being formed by two equilateral triangles sharing a common base which is the diagonally extending further rod means.

In those instances where the split hub assembly is used in a module construction wherein, as in FIG. 2, a rod element such as 21 must pass angularly upwardly with respect to the upper hub means 15 of the split hub assembly 15,23, the upper component of the split hub assembly is suitably notched as at 32 to provide clearance for the end of the rod element 21 particularly in that region thereof immediately adjacent the blade 33 as shown in FIG. 5 wherein the blade passes into the radial slot 34 (see FIG. 2) to allow the blade 33 to be intercepted by the ring 35 held captive between the halves of the hubs as is disclosed fully in my aforesaid prior U.S. Pat. No. 4,280,521.

In the embodiment of the invention illustrated in FIGS. 7, 8 and 9, the basic module as illustrated in FIG. 1 has added thereto the reinforcing rod elements 38, 39, 40 and 41. The inner ends of these reinforcing rod elements are joined by a hub means 42 which is of a smaller diameter than any of the other hubs, the purpose of which will be presently apparent, and the outer ends of these reinforcing rod elements are pivotally connected as by rivets or pins 43 to the respective rod elements 19, 21, 20 and 22. The lengths of these reinforcing rod elements are the same between their pivotal connections 43 and the hub means 42 and it will be understood that the length of a reinforcing rod element will always be less than the length of the rod, such as 21, to which they are attached between the pivot means 43 and the upper end of such rod 21. Dependent upon whether one desires that the hub 42 retreats from the hub means 18 when the assembly is collapsed to bundled condition or whether such hub means 42 advances toward such hub means 18 during the collapsed or bundling of the module, the hub 42 is initially positioned below or above the plane of the pivots 43. In the specific embodiment shown in FIGS. 7, 8 and 9, the reinforcing rod elements 38, 39, 40 and 41 are initially positioned such that they project below the corner hub means of the polygon, in which case when the unit is collapsed to bundled condition, the hub means 42 will be required to project or displace itself away from the hub means 18. If, on the other hand, the reinforcing rod elements 38, 49, 40 and 41 are initially positioned such as to place the hub means 42 above the plane passing through the pivot means 43, then the hub means 42 will advance towards the hubs means 18 when the unit is bundled. In the former case, the length of the bundle will be increased with respect to the length of the bundle formed by the FIG. 1 embodiment alone whereas in the latter case, the bundle length is not increased. In either case, it is of advantage to have the hub means 42 relatively smaller than any of the other hubs, particularly the hub means 18 so as to allow a complete collapse or bundling of the assembly. This will be particularly evident when the hub means 42 advances toward the hub means 18 such that the hub means 42 must be within the inwardly retreating rod elements 19, 20, 21 and 22.

FIG. 10 illustrates an embodiment very similar to the FIG. 9 embodiment but allowing the additional reinforcing rod elements 38′, 39′ and 41′ (the remaining reinforcing rod element corresponding to the rod element 40 is not shown for the purposes of clarity in FIG. 10) to be directly connected to the corresponding hub means 14, 23, 16 and 24 rather than being pivotally connected as at 43 in FIG. 9. Thus, the blades of the paired rod elements such as 21 and 39′ as is shown in FIGS. 11 and 12 may share in side-by-side relationship the common hub slot 50 without interference during collapsing and expanding of the module. It will be appreciated of course that this arrangement cannot be used if it is required that the hub means 42 advances toward the hub means 18 during bundling of the assembly.

What is claimed is:

1. A structural module which is capable of being manipulated between a collapsed condition and an expanded, locked condition, which comprises:

a plurality of rod elements which are disposed generally parallel and in a bundle when said module is in collapsed condition, a first group of hub means pivotally associated with those ends of said rod elements which project toward one end of said bundle and a second group of hub means pivotally associated with those ends of said rod elements which project toward the other end of said bundle, at least some of the hub means of said first group pivotally joining some of said rod elements to each other and at least some of the hub means of said second group pivotally joining some of said rod elements to each other such that said hub means move into a predetermined, pattern as the module is manipulated to expanded condition;

at least one pair of hub means comprised of a hub means of said first group and a hub means of said second group constituting a split hub assembly occupying a particular position in said pattern; and means for locking said pair of hub means together to maintain the frame in expanded condition.

2. In a structural module which is manipulatable between a collapsed, bundled condition and an expanded, locked condition, a plurality of rod elements each having a hub means at each of its opposite ends, the rod elements being movable between a collapsed, bundled condition in which the rod elements are essentially parallel to each other and close together whereby one group of hub means is near one end of the bundle whereas a second group of hub means is near the other end of the bundle and an expanded condition which single rod elements lie in substantially coplanar relation to extend along and define the sides of a polygon and with all corners of the polygon being defined by hub means, at least one pair of hub means consisting of a hub means of said one group and a hub means of said second group constituting component of a split hub assembly lying in a superposed relation at a corner of said polygon, and means for releasably locking said pair of hub means together.

3. A structural module which is capable of being manipulated between a collapsed condition and an expanded, locked condition presenting a rigid, three dimensional open space frame, which comprises:

a plurality of rod elements which are disposed in a bundle when said module is in collapsed condition, a first group of hub means pivotally associated with those ends of said rod elements which project toward one end of said bundle and a second group of hub means pivotally associated with those ends of said rod elements which project toward the other end of said bundle, at least one pair of hub means comprised of a hub means of said first group and a hub means of said second group constituting components of a split hub assembly which are adapted to be guided toward and into engagement with each other when the module is manipulated toward said expanded condition, the remainder of the hub means of said first group pivotally joining some of said rod elements to each other and the remainder of the hub means of said second group pivotally joining some of said rod elements to each other such that said remainder of the hub means of each of said first and second groups thereof spread apart into a predetermined, mutually spaced pattern as the module is manipulated to expanded condition; and means for releasably locking said components of the split hub assembly together to lock the space frame in expanded condition.

4. A structural module as defined in claim 3 wherein said open space frame is of pyramidal shape and said split hub assembly is disposed at a corner of the base of such pyramidal shape.

5. A structural module as defined in claim 3 wherein said open space frame is of polygonal plan view with one of said hub means being disposed in the center of such polygon, one rod element being pivotally connected at one end to said one hub means and pivotally carrying, at its opposite end, a component of said split hub assembly.

6. A structural module as defined in claim 5 wherein a second pair of hub means comprised of a hub means of the first group and a hub means of the second group constitute a second split hub assembly, a further rod element being pivotally connected at one end thereof to said one hub means and pivotally carrying, at its opposite end, a component of said second split hub assembly.

7. A structural module as defined in claim 3 including reinforcing rod elements pivotally joined by an additional hub means and pivotally connected individually to other of said rod elements.

* * * * *